US009962808B2

(12) United States Patent
Nishide et al.

(10) Patent No.: US 9,962,808 B2
(45) Date of Patent: May 8, 2018

(54) HIGH-PRECISION SPHERE SIZE MEASURING DEVICE AND SPHERE POLISHING DEVICE

(71) Applicant: AMATSUJI STEEL BALL MFG. CO., LTD., Osaka (JP)

(72) Inventors: Hiroshi Nishide, Osaka (JP); Kenta Kadotani, Osaka (JP)

(73) Assignee: AMATSUJI STEEL BALL MFG. CO., LTD., Osaka (JP)

( * ) Notice: Subject to any disclaimer, the term of this patent is extended or adjusted under 35 U.S.C. 154(b) by 0 days. days.

(21) Appl. No.: 15/554,114

(22) PCT Filed: Feb. 7, 2017

(86) PCT No.: PCT/JP2017/004337

§ 371 (c)(1),
(2) Date: Aug. 28, 2017

(87) PCT Pub. No.: WO2017/138511

PCT Pub. Date: Aug. 17, 2017

(65) Prior Publication Data

US 2018/0029191 A1 Feb. 1, 2018

(30) Foreign Application Priority Data

Feb. 12, 2016 (JP) ..... 2016-024599

(51) Int. Cl.

| | |
|---|---|
| ***B24B 49/00*** | (2012.01) |
| ***B24B 49/02*** | (2006.01) |
| ***B24B 11/06*** | (2006.01) |

(52) U.S. Cl.

CPC ..... *B24B 49/02* (2013.01); *B24B 11/06* (2013.01)

(58) Field of Classification Search

CPC ..... B24B 49/02; B24B 11/06; G01B 5/08; G01B 7/12

(Continued)

(56) References Cited

U.S. PATENT DOCUMENTS 3,103,770 A * 9/1963 Carter ..... B24B 11/06 125/30.01
4,488,041 A * 12/1984 Baudot ..... G01C 19/28 250/231.12

(Continued)

FOREIGN PATENT DOCUMENTS

| | | |
|---|---|---|
| JP | 6-5858 | 1/1994 |
| JP | 11-223502 | 8/1999 |
| JP | 2012-236260 | 12/2012 |
| JP | 5768485 | 8/2015 |

OTHER PUBLICATIONS

International Search Report dated Mar. 14, 2017 in International (PCT) Application No. PCT/JP2017/004337.

(Continued)

*Primary Examiner* — George Nguyen
(74) *Attorney, Agent, or Firm* — Wenderoth, Lind & Ponack, L.L.P.

(57) ABSTRACT

A sphere size measuring unit (15) measures respective diameters of an object sphere in the course of processing and a standard sphere made of the same material as that of the object sphere and furthermore having a target diameter of the object sphere. A size difference calculation unit (161) calculates a size difference between the diameter of the object sphere and the diameter of the standard sphere. A determination unit (162) compares the obtained size difference with a threshold value so as to determine whether or not the diameter of the object sphere reaches the target value.

4 Claims, 5 Drawing Sheets

(58) Field of Classification Search
USPC ..... 451/5, 49; 33/555.1
See application file for complete search history.

(56) References Cited

U.S. PATENT DOCUMENTS

| | | | | | |
|---|---|---|---|---|---|
| 4,528,759 | A * | 7/1985 | Joyce | A63B 47/008 | 33/501 |
| 4,779,387 | A * | 10/1988 | Reid | A63B 45/00 | 451/308 |
| 4,903,413 | A * | 2/1990 | Bellwood | G01B 5/207 | 33/551 |
| 5,906,535 | A * | 5/1999 | Tonooka | B24B 11/06 | 384/12 |
| 6,082,015 | A * | 7/2000 | Bjorkdahl | A63B 47/008 | 33/501 |
| 6,171,179 | B1 * | 1/2001 | Chiou | B24B 11/06 | 451/262 |
| 6,247,241 | B1 | 6/2001 | Hashimoto | | |
| 6,752,696 | B2 * | 6/2004 | Murai | F16C 19/36 | 451/49 |
| 2011/0177760 | A1 * | 7/2011 | Tanaka | B24B 11/06 | 451/50 |

OTHER PUBLICATIONS

Notification of Reasons for Refusal dated Mar. 15, 2016 in corresponding Japanese Patent Application No. 2016-024599 with English translation.

* cited by examiner

HIGH-PRECISION SPHERE SIZE MEASURING DEVICE AND SPHERE POLISHING DEVICE

TECHNICAL FIELD

The present invention relates to a high-precision sphere size measuring device mounted on a sphere processing device, and to a sphere polishing device including the above device.

BACKGROUND ART

Spheres such as steel balls and ceramic balls, which are used for ball bearings and the like, are manufactured by a sphere polishing device. The sphere polishing device includes a sphere size measuring device for measuring the size of the spheres, thus some spheres in the course of processing are extracted as object spheres and the sizes thereof are measured by the sphere size measuring device. Processing operations of the sphere polishing device are controlled according to diameters of the measured spheres. For example, Patent Document 1 discloses that the spheres are processed in consideration of the efficiency till the diameter of the object sphere reaches a predetermined value, and that after the diameter of the object sphere reaches the predetermined value, then the spheres are processed in consideration of the quality.

Patent Document 2 discloses a sphere size measuring device including a posture changing mechanism for changing the posture of the object sphere. Since the average diameter is calculated based on measured values at a plurality of positions, the measurement accuracy can be improved.

PRIOR ART DOCUMENTS

Patent Documents

[Patent Document 1] JP-UM H06-005858 A

[Patent Document 2] JP No. 5768485

SUMMARY OF THE INVENTION

Problem to be Solved by the Invention

The sphere size measuring device of Patent Document 2 measures the actual diameter of the object sphere. However, the temperature of the spheres subjected to the processing changes due to heat and the like generated by polishing. Thus, it is difficult to maintain a constant temperature of the object sphere for the entire period from the beginning to the end of the processing. As the temperature of the object sphere changes, the size thereof also changes. For this reason, the method for measuring the actual size of the object sphere may cause variations in measurement accuracy depending on the measurement timing. Also, in the method for measuring the actual size by exerting a measuring force to the object, elastic deformation is generated due to the measuring force and the mass of the steel ball. Therefore, correction calculations are required to eliminate the influence of the elastic deformation and to improve the measurement accuracy (see the Japanese Industrial Standard JIS B1501-2009, Annex JB). However, the correction calculations are extremely complicated while the improvement in the accuracy is limited. The variations in measurement accuracy naturally affect the size accuracy of the end products.

The present invention was made in consideration of the above circumstances, an object of which is to provide a high-precision sphere size measuring device and a sphere polishing device capable of suppressing variations in measurement accuracy.

Means for Solving the Problem

In order to resolve the above problem, the present invention provides a high-precision sphere size measuring device mounted on a sphere polishing device configured to process spheres. The high-precision sphere size measuring device includes: a size difference calculation unit that calculates a size difference between the diameter of an object sphere in the course of processing and the diameter of a standard sphere made of the same material as that of the object sphere and furthermore having a target diameter of the object sphere; and a determination unit that compares the obtained size difference with a threshold value so as to determine whether or not the diameter of the object sphere reaches the target value.

In the configuration as described above, the standard sphere to be used is a sphere made of the same material as that of the object sphere and furthermore having the target diameter of the object sphere. Therefore, when calculating the size difference between the respective measured values of the object sphere and the standard sphere, it is possible to prevent measurement accuracy from being affected by elastic deformation. Furthermore, since the object sphere and the standard sphere are measured under the same environment, it is possible to prevent measurement accuracy from being affected by expansion or contraction of the spheres. Thus, with the high-precision sphere size measuring device, it is possible to perform a high-precision measurement without variation for the entire period from the beginning to the end of the polishing work.

Also, the high-precision sphere size measuring device includes a sphere size measuring unit that measures each diameter parameter, which is obtained by adding a certain fixed value to each diameter, of the object sphere and the standard sphere. Also, the size difference calculation unit calculates, as the size difference, the difference between the diameter parameter of the object sphere and the diameter parameter of the standard sphere both measured by the sphere size measuring unit.

With the configuration as described above, when obtaining the size difference between the diameter of the object sphere and the diameter of the standard sphere, it is not necessary to measure the diameter itself of the object sphere and the standard sphere. Therefore, high-precision adjustment operations of a sensor used for measuring are not required, thus it is possible to use a simple measuring method.

Also, in the high-precision sphere size measuring device, the sphere size measuring unit includes a washing part that washes the object sphere before measurement with washing oil. Furthermore, since the object sphere and the standard sphere are measured in the washing oil, they can be measured under the same environment. Thus, it is possible to prevent the measurement accuracy from being affected by expansion or contraction of the spheres.

With the configuration as described above, the object sphere in the course of processing can be cooled with the washing oil before it is measured. Thus, it is possible to measure the object sphere and the standard sphere under the same environment (for example, at the same temperature). For this reason, it is possible to prevent the measurement accuracy from being affected by expansion or contraction of the spheres, and furthermore to perform a high-precision measurement.

In the high-precision sphere size measuring device, the sphere size measuring unit may reciprocatingly move and roll the object sphere on the base so as to measure respective diameters at multiple positions of the object sphere while changing the posture of the object sphere.

With the configuration as described above, the posture of the object sphere is changed by moving and rolling the object sphere reciprocatingly on the base. Thus, only a configuration (for example, a linear actuator) to move the object sphere reciprocatingly on the base in one direction is sufficient to change the posture of the object sphere. Thus, it is possible to change the posture of the object sphere with a simple configuration.

The sphere polishing device of the present invention includes a polishing unit that polishes spheres and a conveyor that transports the spheres polished by the polishing unit so as to supply the polished spheres again to the polishing unit. The sphere polishing device is provided with the above-described high-precision sphere size measuring device that picks up the object sphere from the conveyor.

With the configuration as described above, it is possible to perform a high-precision measurement without variation for the entire period from the beginning to the end of the polishing work in the sphere polishing device.

The sphere polishing device as described above may further include a polishing control section that controls operations of the polishing unit in response to a measurement result from the high-precision sphere size measuring device. The determination unit may compare the size difference calculated by the size difference calculation unit with a first threshold value and a second threshold value larger than the first threshold value. The polishing control section may switch the operations of the polishing unit from rough processing to finishing processing when it is determined that the size difference reaches the second threshold value, and may terminate the processing in the polishing unit when it is determined that the size difference reaches the first threshold value.

Effect of the Invention

The high-precision sphere size measuring device and the sphere polishing device of the present invention compare the size difference between the diameter of the object sphere and the diameter of the standard sphere with the threshold value so as to determine whether or not the diameter of the object sphere reaches the target value. The standard sphere to be used is a sphere made of the same material as that of the object sphere and furthermore having the target diameter of the object sphere. Therefore, when the size difference is calculated based on the measured values (diameters) of the object sphere and the standard sphere, it is possible to prevent the measurement accuracy from being affected by elastic deformation. Furthermore, since the object sphere and the standard sphere are measured under the same environment, it is also possible to prevent the measurement accuracy from being affected by expansion or contraction of the sphere. As a result, the present invention can provide an effect that a high-precision measurement can be performed without variation for the entire period from the beginning to the end of the polishing work.

MODES FOR CARRYING OUT THE INVENTION

Hereinafter, an embodiment of the present invention will be described in detail with reference to the drawings. First, a description will be given, with reference to FIG. 1, on a schematic configuration of a sphere polishing device to which the present invention is applied.

Figure 1:
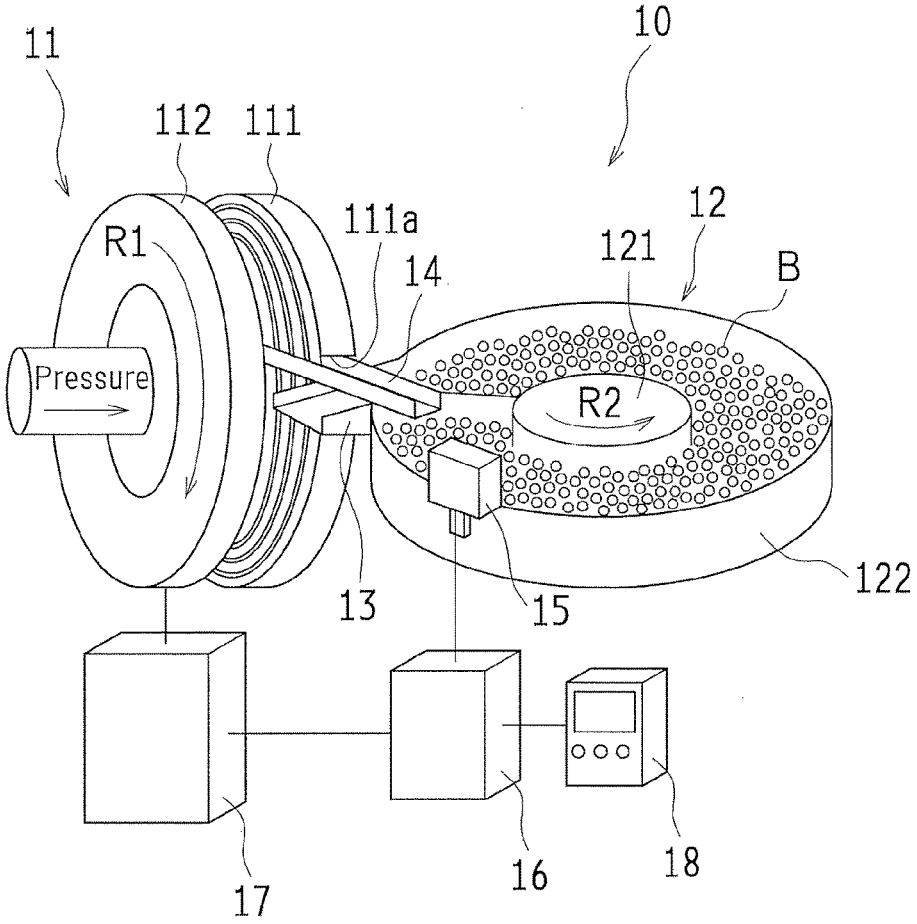
FIG. 1 is a perspective view showing a schematic configuration of a sphere polishing device in an embodiment of the present invention.

A sphere polishing device 10 as shown in FIG. 1 includes: a polishing unit 11; a conveyor 12; a feeding chute 13; a discharge chute 14; a sphere size measuring unit 15; a measurement control section 16; a polishing control section 17; and an operation section 18.

The polishing unit 11 includes a fixed disk 111 and a rotary disk 112. On respective surfaces facing each other of the above disks 111 and 112, grinding wheels are mounted. The respective grinding wheels have the same (plural) number of grooves arranged in concentric patterns so that spheres roll along the grooves. The rotary disk 112 is rotated in a predetermined direction (i.e. direction indicated by the arrow R1 in FIG. 1) while a pressure is applied along the axis of rotation of the rotary disk 112. Thus, the spheres (for example, steel balls or ceramic balls) B moves in the grooves between the disks with being subjected to polishing processing by the grinding wheels.

The conveyor 12 is connected to the polishing unit 11 via the feeding chute 13 and the discharge chute 14. That is, the spheres B to be polished by the polishing unit 11 are supplied from the conveyor 12 to the polishing unit 11 via the feeding chute 13. The polished spheres B by the polishing unit 11 return to the conveyor 12 from the polishing unit 11 via the discharge chute 14. The conveyor 12 rotates an inner ring 121 and a bottom plate in a predetermined direction (i.e. direction indicated by the arrow R2 in FIG. 1) to transport the spheres B. Thus, the spheres B that have returned from the polishing unit 11 are again transported to the polishing unit 11.

The fixed disk 111 is provided with a cut-out part 111*a* in which the feeding chute 13 and the discharge chute 14 are consecutively provided.

In the sphere polishing device 10, the spheres B are repeatedly supplied to the polishing unit 11 by the conveyor 12, and are repeatedly subjected to polishing. When the size (diameter) of the spheres B reaches a target value due to repeatedly performed polishing, the polishing processing is terminated. Also, when the target value to terminate the polishing processing is set to a first target value, rough processing may be performed in consideration of processing efficiency until the size of the spheres B reaches a second target value larger than the first target value, and after the size of the spheres has reached the second target value, finishing processing may be performed in consideration of processing quality. The finishing processing can be performed by reducing the pressure to be applied to the rotary disk 112 and/or reducing the rotational speed of the rotary disk 112, compared to the rough processing.

The sphere size measuring unit 15 is attached to an outer ring 122 of the conveyor 12 so as to be disposed in the vicinity of the downstream of the discharge chute 14 (i.e. downstream of the transporting direction of the spheres B). The sphere size measuring unit 15 is to measure the size of the spheres B in the course of the polishing processing, in particular, to pick up an object sphere B1 (see FIG. 2) as the measurement sample among the spheres B returned to the conveyor 12 from the polishing unit 11 and to measure the diameter of the object sphere B1. The measurement control section 16 is to control operations of the sphere size measuring unit 15 and to determine a measurement result from the sphere size measuring unit 15.

The polishing control section 17 is to control operations of the polishing unit 11 in response to the measurement result from the measurement control section 16. The operation section 18 is to display the measurement result from the sphere size measuring unit 15, for example, by means of a touch panel, and also to set various conditions in response to input by an operator.

Figure 2:
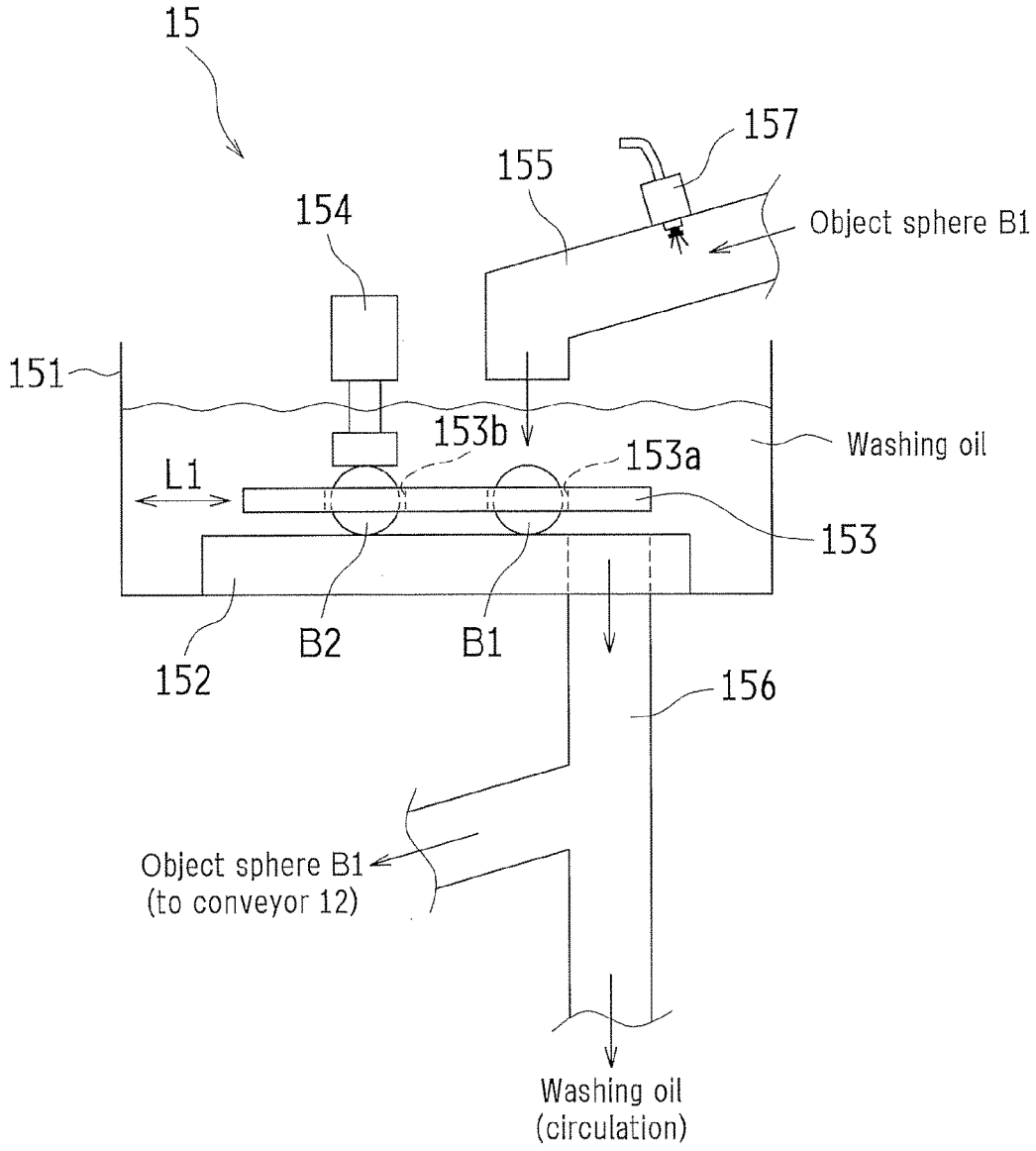
FIG. 2 is a front view showing a schematic configuration of a sphere size measuring unit mounted on the sphere polishing device.
Figure 3:
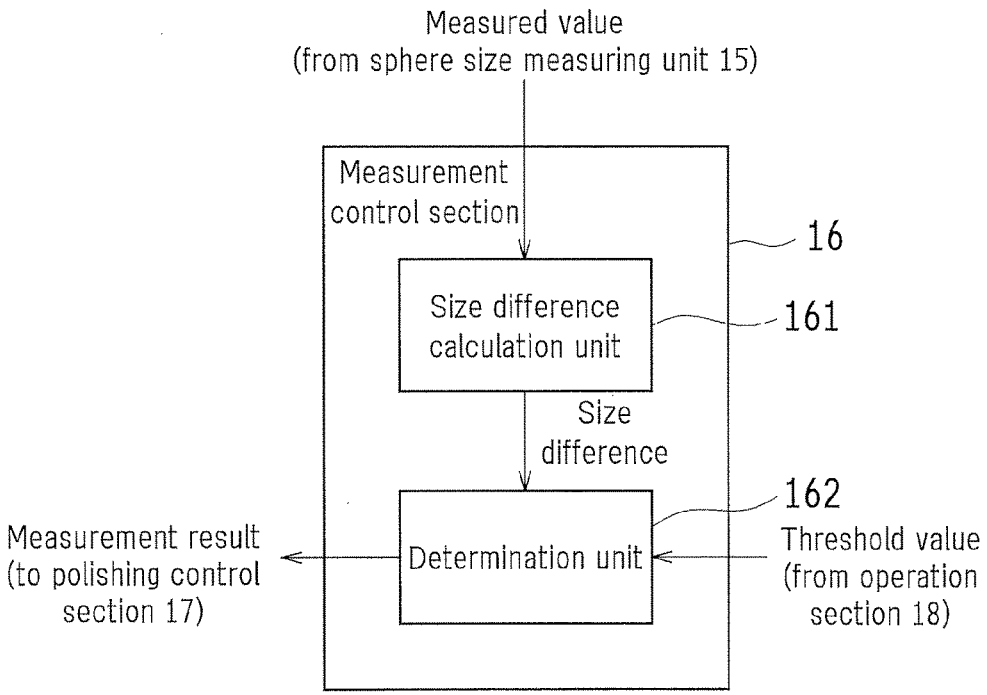
FIG. 3 is a block diagram showing a schematic configuration of a measurement control section mounted on the sphere polishing device.

Next, a description will be given in detail on a high-precision sphere size measuring device, which is a characteristic configuration of the present invention, with reference to the drawings. In this embodiment, the high-precision sphere size measuring device of the present invention is constituted by the sphere size measuring unit 15 and the measurement control section 16. FIG. 2 is a front view showing a schematic configuration of the sphere size measuring unit 15. FIG. 3 is a block diagram showing a schematic configuration of the measurement control section 16.

As shown in FIG. 2, the sphere size measuring unit 15 includes: a measuring tank 151; a base 152; a holding member 153; a contact displacement sensor (hereinafter simply referred to as the "sensor") 154; an introducing path 155; and a discharge path 156.

The object sphere B1 to be measured by the sphere size measuring unit 15 is picked up from the conveyor 12 by a pickup part (not shown) so as to be introduced to an inside of the measuring tank 151 through the introducing path 155. The introducing path 155 includes a washing part 157 so as to remove polishing residues or dusts on the surface of the object sphere B1 by means of shower washing by washing oil. Also, the object sphere B1, which was in the course of the processing and has just been picked up from the conveyor 12, has a high temperature due to polishing heat. The washing oil cools such heat of the object sphere B1.

In the measuring tank 151, the base 152, the holding member 153 and the sensor 154 are disposed. The base 152 includes a horizontal placing surface on which the object sphere B1 and a standard sphere B2 are placed. The holding member 153 can be slidingly moved above the base 152 in one horizontal direction (direction indicated by the allow L1 in the figure) by means of a linear actuator (not shown) while holding the object sphere B1 and the standard sphere B2. The sensor 154 is to measure a size parameter (hereinafter referred to as a "diameter parameter") with respect to the respective diameters of the object sphere B1 and the standard sphere B2 on the base 152. Here, the diameter parameter means a value obtained by adding a certain fixed value to the diameter, however, it can also include the diameter itself (when the above fixed value is zero (0)).

The holding member 153 is provided with two holding holes, i.e. a holding hole 153*a* for the object sphere B1 and a holding hole 153*b* for the standard sphere B2. The object sphere B1 and the standard sphere B2 are held respectively inside these holding holes. The holding holes 153*a* and 153*b* are each a circular-shaped hole having a diameter slightly larger than each diameter of the object sphere B1 and the standard sphere B2. The object sphere B1 transported to the measuring tank 151 is dropped from the introducing path 155 into the holding hole 153*a*. The standard sphere B2 is held in advance in the holding hole 153*b*. The measuring tank 151 is filled with the washing oil so that the object sphere B1 and the standard sphere B2 are completely submerged in the washing oil. The standard sphere B2 is a finely processed sphere made of the same material as that of the object sphere B1, and having the same diameter as the target value (target diameter) of the object sphere B1. Specifically, the processed spheres B are subjected to a comparative measurement with a block gauge designated as "Class zero (0)" by the Japanese Industrial Standards (JIS) so as to select a sphere B that was processed with especially high accuracy as the standard sphere B2 to be used. Also, the washing oil is recirculated and used while being subjected to, for example, filtering so as to remove polishing residues removed from the surface of the spheres.

The object sphere B1 and the standard sphere B2 simultaneously roll according to sliding of the holding member 153 then sequentially reach the position directly under the sensor 154. The sensor 154 measures respective diameter parameters of the object sphere B1 and the standard sphere B2 transported directly under the sensor 154, and outputs the measured values to the measurement control section 16. The measurement control section 16 can calculate, as a size difference, the difference between the respective diameter parameters of the object sphere B1 and the standard sphere B2 so as to store the obtained size difference. Here, since the diameter parameter is a value obtained by adding the certain fixed value to the diameter, the difference between the respective diameter parameters of the object sphere B1 and the standard sphere B2 equal the size difference between the respective diameters of the object sphere B1 and the standard sphere B2, because the above fixed values are balanced out.

Figure 4:
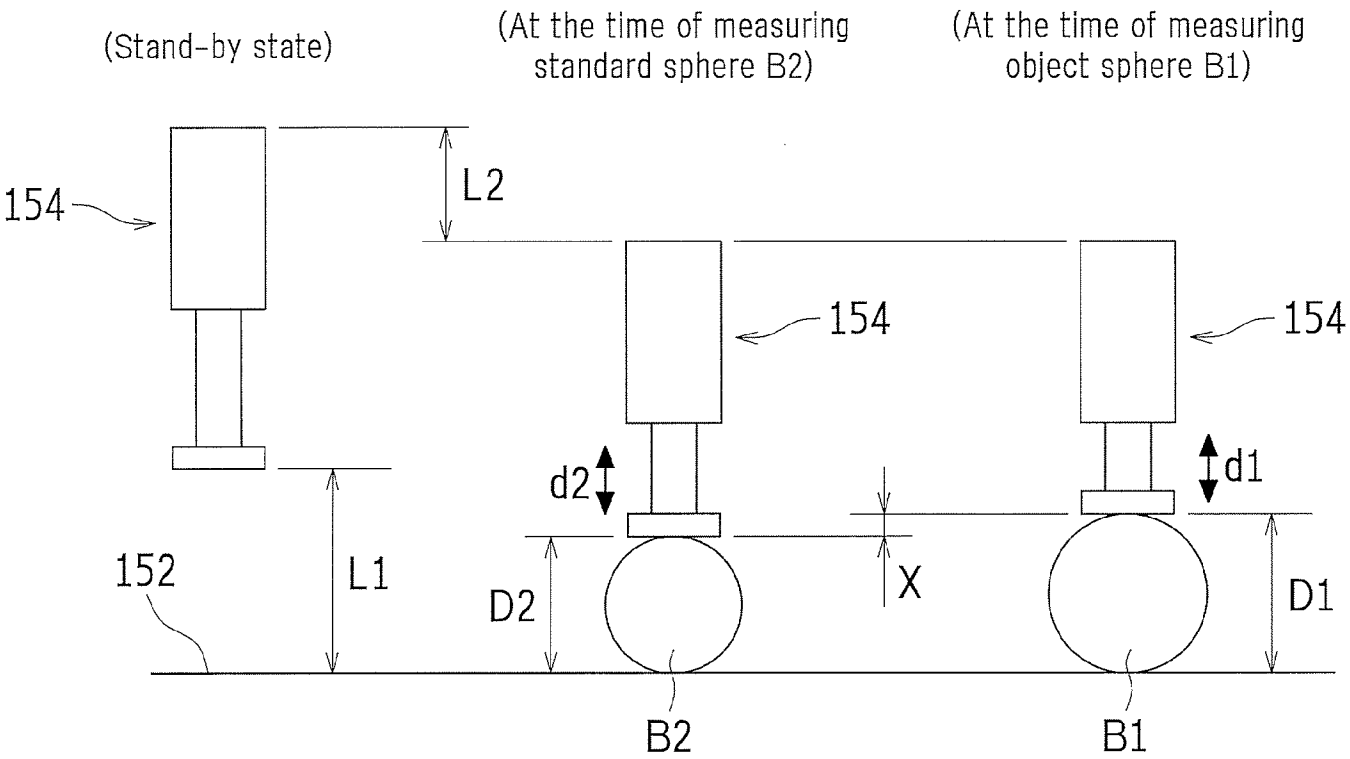
FIG. 4 is a diagram showing a specific example of a measurement of diameter parameters by the sphere size measuring unit.

Now, a description on a specific example of the measurement of the diameter parameters by the sphere size measuring unit 15 is given with reference to FIG. 4. FIG. 4 shows, from left to right, a stand-by state of the sensor 154, a state of the sensor 154 at the time of measuring the standard sphere B2, and a state of the sensor 154 at the time of measuring the object sphere B1. Note that, in FIG. 4, although the above three states are illustrated side by side for the sake of convenience of explanation, actually the respective measurements of the object sphere B1 and the standard sphere B2 are performed by moving each of the object sphere B1 and the standard sphere B2 directly under the sensor 154. That is, the above three states show the same position on the base 152.

In the stand-by state of the sensor 154, the tip of the contact part of the sensor 154 is spaced apart from the placing surface (horizontal surface) of the base 152 by the distance L1. The output value of the sensor 154 in this state is zero (0). Then, at the time of measuring the standard sphere B2 and the object sphere B1, the sensor 154 moves vertically downward by the movement distance L2 (<L1).

Here, the diameters of the object sphere B1 and the standard sphere B2 are represented, respectively, by D1 and D2. Also, the sensor displacement amounts (output values from the sensor 154) at the time of measuring the object sphere B1 and the standard sphere B2 are represented, respectively, by d1 and d2. Thus, the sensor displacement amount d1 at the time of measuring the object sphere B1 is expressed by the following expression:

$$d1=D1-(L1-L2)=D1+(L2-L1),$$

and the sensor displacement amount d2 at the time of measuring the standard sphere B2 is expressed by the following expression:

$$d2=D2-(L1-L2)=D2+(L2-L1).$$

That is, the sensor displacement amounts d1 and d2 are respectively the values obtained by adding the fixed value (L2−L1) to the diameter D1 of the object sphere B1 and the diameter D2 of the standard sphere B2. Accordingly, the sensor displacement amounts d1 and d2 are the above-described diameter parameters. Thus, in the sphere size measuring unit 15, high-precision adjustment operations of the sensor 154 are not required to measure the sensor displacement amounts d1 and d2, and the diameter parameter can be easily obtained.

The sphere size measuring unit 15 reciprocatingly moves the holding member 153 multiple times so as to change the posture of the object sphere B1 while measuring the respective diameter parameters at the different positions of the object sphere B1. Since the object sphere B1 is held by the holding hole 153*a* slightly larger than the object sphere B1, the object sphere B1 does not completely linearly move when it rolls according to sliding of the holding member 153, but rolls while changing its posture every time the holding member 153 reciprocatingly moves. Thus, it is possible to measure the unequality of diameters (i.e. difference between the maximum diameter and the minimum diameter of one sphere) by measuring multiple times the diameter of the object sphere B1 while changing its posture. Also, with the high-precision sphere size measuring device according to this embodiment, it is possible to obtain diameter variation per lot (i.e. difference between the average diameter of the largest sphere and the average diameter of the smallest sphere in one lot).

When the measurement of the object sphere B1 is terminated, the holding member 153 moves to a predetermined position so as to drop the object sphere B1 from the upper surface of the base 152 into the discharge path 156. The object sphere B1 dropped into the discharge path 156 is returned again to the conveyor 12.

Now, a description is given on processing in the measurement control section 16. As shown in FIG. 3, the measurement control section 16 includes a size difference calculation unit 161 and a determination unit 162. To the size difference calculation unit 161, the following are input: the measured values by the sphere size measuring unit 15, i.e. the measured diameter parameters of the object sphere B1 and the standard sphere B2. The size difference calculation unit 161 calculates the difference, based on the input measured values, as the size difference between the diameter of the object sphere B1 and the diameter of the standard sphere B2. In the example shown in FIG. 4, the sensor displacement amounts d1 and d2 are input as the diameter parameters of the object sphere B1 and the standard sphere B2. The difference is expressed by the following expression:

$$d1-d2=D1+(L2-L1)-(D2+(L2-L1))=D1-D2=X.$$

That is, the size difference X between the diameter of the object sphere B1 and the diameter of the standard sphere B2 shown in FIG. 4 is obtained as the difference between the respective sensor displacement amounts d1 and d2. Here, the sensor displacement amounts d1 and d2 may not be necessarily obtained by one measurement. For example, they may be the respective average values obtained by multiple measurements while changing the posture of the object sphere B1 and the standard sphere B2.

The size difference calculated as described above is input to the determination unit 162 so as to be compared with a predetermined threshold value and be determined. As the threshold value used by the determination unit 162, at least a first threshold value TH1 (see FIG. 4) is used in order to terminate the polishing processing in the polishing unit 11. Also, a second threshold value TH2 (see FIG. 4) may be used, in addition to the above first threshold value TH1, in order to switch the polishing processing in the polishing unit 11 from the rough processing to the finishing processing. The first threshold value TH1 and/or the second threshold value TH2 can be set and input by an operator via the operation section 18 so as to be stored in a memory (not shown) in the measurement control section 16 and to be used for the above determination.

When the determination unit 162 determines that the size difference reaches the threshold value, the determination result is transmitted to the polishing control section 17. The polishing control section 17 controls the operations of the polishing unit 11 in response to the determination result. Specifically, when the size difference reaches the second threshold value TH2, the polishing processing in the polishing unit 11 is switched from the rough processing to the finishing processing. Also, when the size difference reaches the first threshold value TH1, the polishing processing in the polishing unit 11 is terminated.

In the high-precision sphere size measuring device according to this embodiment, the standard sphere B2 used in the sphere size measuring unit 15 is a sphere: made of the same material as that of the object sphere B1; and having the target diameter of the object sphere B1. Therefore, when the size difference is calculated based on the measured values (diameters) of the object sphere B1 and the standard sphere B2, it is possible to prevent the measurement accuracy from being affected by elastic deformation. Furthermore, the measurement is performed in a state in which the object sphere B1 and the standard sphere B2 have the same temperature in the washing oil. Thus, it is also possible, in calculating the size difference, to prevent the measurement accuracy from being affected by expansion or contraction of the sphere B. Since the high-precision sphere size measuring device according to this embodiment has the above-described features, it is possible to perform a high-precision measurement without variation for the entire period from the beginning to the end of the polishing work.

Also, in the sphere size measuring unit 15, the simple reciprocating movement of the holding member 153 can cause the change in the posture of the object sphere B1. Thus, it is possible to change the posture of the object sphere B1 with a simple configuration.

Figure 5:
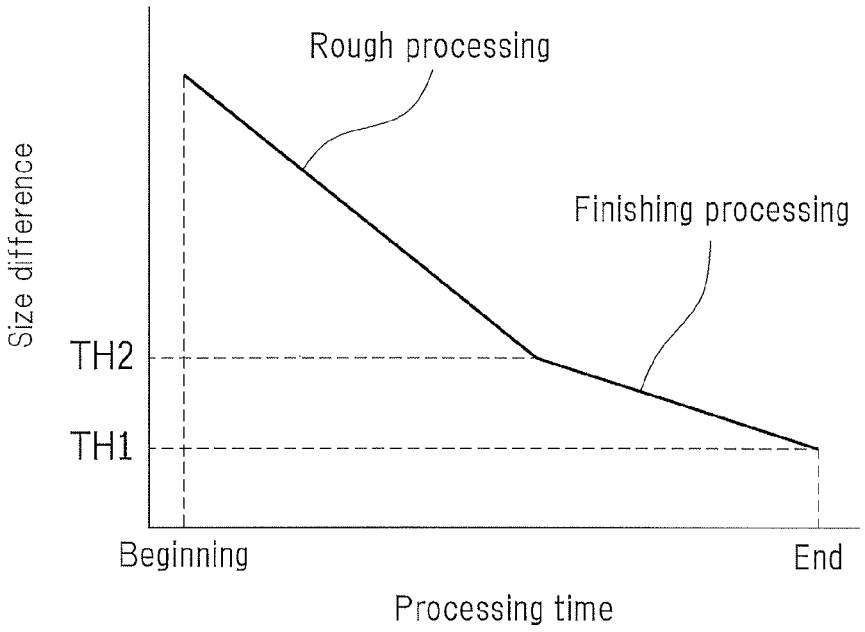
FIG. 5 is a graph indicating a processing curve by the sphere polishing device.

Now, a description on a processing flow for one lot using the sphere polishing device 10 is given. FIG. 5 is a graph indicating a processing curve by the sphere polishing device 10. In the description below, one example is indicated in which: the processing is performed based on a size difference threshold value and a processing time both set in advance; the processing is switched from the rough processing to the finishing processing when the size difference reaches the second threshold value TH2; and the processing is terminated when the size difference reaches the first threshold value TH1.

The measurement of a first sphere in the sphere size measuring unit 15 is a rough sphere size measurement, in other words, the size of the sphere B before subjected to the processing is measured. Based on the rough sphere size and the predetermined processing time, an ideal processing curve (hereinafter referred to as the "ideal curve") is generated.

After that, the measurement is periodically performed at the predetermined measurement intervals. Also, the processing is performed under observation so that the processing curve based on the actually measured values is not largely deviated from the ideal curve.

When the size difference between the object sphere B1 and the standard sphere B2 reaches the second threshold value TH2, a signal is output from the measurement control section 16 to the polishing control section 17 so as to switch the processing from the rough processing to the finishing processing. After the finishing processing is started, the periodical measurement is performed for a while at the above predetermined measurement intervals. Then, when the diameter of the spheres moves toward the finished size (for example, when a predetermined period of time elapses after the finishing processing is started), the measurement interval is shortened so as to prevent excess polishing.

When the size difference between the object sphere B1 and the standard sphere B2 reaches the first threshold value TH1, it is determined that the size (diameter) of the spheres B reaches the target value, and a signal is output from the measurement control section 16 to the polishing control section 17 so as to stop the operations of the sphere polishing device 10. Thus, the processing for the lot is completed.

The foregoing examples are to be considered in all respects as illustrative and not limiting. The technical scope of the present invention is indicated by the appended claims rather than by the foregoing description, and all modifications and changes that come within the meaning and range of equivalency of the claims are intended to be embraced therein.

This application claims priority on Patent Applications No. 2016-024599 filed in Japan on Feb. 12, 2016, which are hereby incorporated by reference in their entirety.

DESCRIPTION OF REFERENCE NUMERALS

10 Sphere polishing device
11 Polishing unit
12 Conveyor
13 Feeding chute
14 Discharge chute
15 Sphere size measuring unit
151 Measuring tank
152 Base
153 Holding member
154 Contact displacement sensor
155 Introducing path
156 Discharge path
157 Washing part
16 Measurement control section
161 Size difference calculation unit
162 Determination unit
17 Polishing control section
18 Operation section
B1 Object sphere
B2 Standard sphere
TH1 First threshold value
TH2 Second threshold value

The invention claimed is:

1. A high-precision sphere size measuring device mounted on a sphere polishing device configured to process spheres, the high-precision sphere size measuring device comprising:

a sphere size measuring unit configured to measure each diameter parameter of a standard sphere and an object sphere that is in a course of processing by the sphere polishing device, the diameter parameter being obtained by adding a certain fixed value to each diameter;

a size difference calculation unit configured to obtain, as a size difference between the diameter of the object sphere and the diameter of the standard sphere, a difference between the diameter parameter of the object sphere and the diameter parameter of the standard sphere both measured by the sphere size measuring unit; and a determination unit configured to compare the size difference with a threshold value so as to determine whether or not the diameter of the object sphere reaches a target value, wherein the sphere size measuring unit includes a washing part configured to wash, with washing oil, the object sphere before the measurement, and wherein the sphere size measuring unit measures the object sphere and the standard sphere in the washing oil so as to measure the object sphere and the standard sphere under a same environment and to prevent measurement accuracy from being affected by expansion or contraction of the spheres.

2. The high-precision sphere size measuring device according to claim 1, wherein the sphere size measuring unit reciprocatingly moves and rolls the object sphere on a base so as to measure respective diameters at multiple positions of the object sphere while changing a posture of the object sphere.

3. A sphere polishing device including a polishing unit configured to polish spheres and a conveyor configured to transport the spheres polished by the polishing unit so as to supply again the polished spheres to the polishing unit, the sphere polishing device comprising:

the high-precision sphere size measuring device according to claim 1 wherein the high-precision sphere size measuring device picks up the object sphere from the conveyor.

4. The sphere polishing device according to claim 3, further comprising a polishing control section configured to control operations of the polishing unit in response to a measurement result from the high-precision sphere size measuring device, wherein the determination unit compares the size difference calculated by the size difference calculation unit with a first threshold value and a second threshold value larger than the first threshold value, and wherein the polishing control section switches the operations of the polishing unit from rough processing to finishing processing when it is determined that the size difference reaches the second threshold value, and terminates the processing in the polishing unit when it is determined that the size difference reaches the first threshold value.

* * * * *